US011221112B2

(12) United States Patent
Mitsuzuka et al.

(10) Patent No.: US 11,221,112 B2
(45) Date of Patent: Jan. 11, 2022

(54) LED ILLUMINATION DEVICE HAVING LIGHT REFLECTING AND TRANSMITTING MEMBER

(71) Applicant: ABRAM Corporation, Tokyo (JP)

(72) Inventors: Hidetoshi Mitsuzuka, Tokyo (JP); Yujiro Kojima, Tokyo (JP); Kenichi Kurihara, Tokyo (JP); Kazunori Kojima, Tokyo (JP); Koji Ishii, Tokyo (JP)

(73) Assignee: ABRAM CORPORATION, Tokyo (JP)

( * ) Notice: Subject to any disclaimer, the term of this patent is extended or adjusted under 35 U.S.C. 154(b) by 0 days.

(21) Appl. No.: 16/337,064

(22) PCT Filed: Sep. 26, 2017

(86) PCT No.: PCT/JP2017/036898
§ 371 (c)(1),
(2) Date: Dec. 19, 2019

(87) PCT Pub. No.: WO2018/062576
PCT Pub. Date: Apr. 5, 2018

(65) Prior Publication Data

US 2020/0141544 A1 May 7, 2020

(30) Foreign Application Priority Data

Sep. 29, 2016 (JP) ..... JP2016-203910

(51) Int. Cl.
*F21K 9/27* (2016.01)
*F21K 9/68* (2016.01)
(Continued)

(52) U.S. Cl.
CPC ..... *F21K 9/68* (2016.08); *F21K 9/27* (2016.08); *F21K 9/278* (2016.08); *F21K 9/66* (2016.08);
(Continued)

(58) Field of Classification Search
CPC .... F21Y 2103/10; F21Y 2115/10; F21K 9/27; F21K 9/275; F21K 9/62
See application file for complete search history.

(56) References Cited

U.S. PATENT DOCUMENTS 6,860,628 B2 * 3/2005 Robertson ..... F21V 23/02 362/555
7,267,461 B2 * 9/2007 Kan ..... F21V 29/74 362/373
(Continued)

*Primary Examiner* — Ismael Negron
(74) *Attorney, Agent, or Firm* — Westerman, Hattori, Daniels & Adrian, LLP

(57) ABSTRACT

A light emitting diode illumination device includes an LED illumination tube having a light transmission plate, an LED element provided in the tube, light reflecting members extending toward a main light irradiation direction symmetrically or asymmetrically with respect to a center line of the LED element, and light intensity and distribution control means for controlling intensity and distribution of a light irradiated from the LED element. The light reflecting member may include a light transmissive member to control the light intensity and distribution. The illumination device may further include light confining means for confining the light emitted from the LED element in a space between the light transmission plate and the light reflecting member and emitting the confined light to the outside of the LED illumination tube through the light transmission plate.

3 Claims, 11 Drawing Sheets

(51) Int. Cl.

| | |
|---|---|
| ***F21K 9/66*** | (2016.01) |
| ***F21K 9/278*** | (2016.01) |
| *F21Y 103/10* | (2016.01) |
| *F21Y 115/10* | (2016.01) |

(52) U.S. Cl.
CPC ..... *F21Y 2103/10* (2016.08); *F21Y 2115/10* (2016.08)

(56) References Cited

U.S. PATENT DOCUMENTS

| | | | | |
|---|---|---|---|---|
| 7,722,221 | B2 * | 5/2010 | Chae | F21K 9/275 362/217.05 |
| 7,815,338 | B2 * | 10/2010 | Siemiet | F21V 29/74 362/218 |
| 9,097,408 | B2 * | 8/2015 | Su | F21V 19/004 |
| 9,285,084 | B2 * | 3/2016 | Amrine, Jr. | F21V 3/02 |
| 9,752,735 | B2 * | 9/2017 | Chamberlain | F21K 9/275 |
| 10,161,570 | B2 * | 12/2018 | Yuan | F21V 15/015 |
| 2010/0008085 | A1 * | 1/2010 | Ivey | F21K 9/27 362/218 |
| 2011/0103053 | A1 * | 5/2011 | Chen | F21V 7/0008 362/235 |
| 2012/0106144 | A1 * | 5/2012 | Chang | F21K 9/69 362/218 |
| 2014/0078771 | A1 * | 3/2014 | Chen | F21V 29/70 362/555 |
| 2017/0254485 | A1 * | 9/2017 | Mitsuzuka | F21V 7/005 |

* cited by examiner

FIG. 7(b)

④ Light distribution of commercially-available linear tube LED

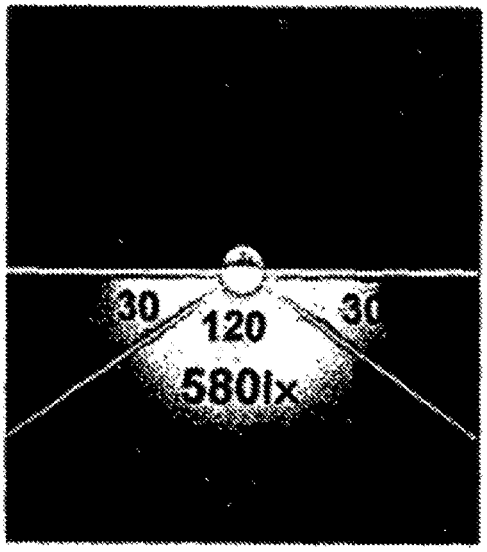

The commercially-available LED is designed to have 120-degree light distribution and does not effectively use each 30-degree area of the left and right sides (total 90-degree). Since the LED does not have a reflection member, it shows the same distribution in vertical irradiation.

The commercially-available linear tube LED has smaller illumination intensity as compared with a fluorescent lamp with a reflection plate.

⑤ Irradiation of light from Abraham LED (clear 120 deg., milk-white 180 deg.) · illumination intensity · PPFD Illumination intensity Lx: 1680 (5000K clear) ~ 750 (3000K milk-while)

PPFD: 175 (5000K clear) 150 (3000K milk-while) mol, 20cm vertical direction

Entire light beam: 2680lm

Comparison without cover

| | 90 | 85 | 80 | 75 | 70 | 65 | 60 | 55 | 50 | 45 | 40 | 35 | 30 | 25 | 20 | 15 | 10 | 5 | 0 |
|---|---|---|---|---|---|---|---|---|---|---|---|---|---|---|---|---|---|---|---|
| LED only | 392 | 388 | 383 | 376 | 365 | 350 | 334 | 313 | 294 | 268 | 242 | 216 | 188 | 160 | 132 | 101 | 74 | 47 | 25 |
| ABRAM Heatsink no cover | 647 | 605 | 528 | 485 | 478 | 468 | 374 | 310 | 277 | 184 | 52 | 11 | 5 | 5 | 5 | 5 | 5 | 5 | 5 |
| High reflection 100% thick. 0.8 wing 20 no cover | 556 | 554 | 545 | 528 | 496 | 390 | 170 | 139 | 115 | 85 | 67 | 54 | 44 | 34 | 30 | 23 | 20 | 18 | 16 |
| High reflection 100% thick. 0.8 wing 15 no cover | 533 | 530 | 522 | 498 | 468 | 443 | 305 | 145 | 125 | 98 | 78 | 60 | 48 | 39 | 33 | 27 | 23 | 20 | 15 |
| High reflection 100% thick. 0.8 wing 10 no cover | 500 | 498 | 490 | 475 | 455 | 438 | 400 | 285 | 162 | 120 | 105 | 88 | 71 | 59 | 49 | 42 | 35 | 30 | 24 |
| High reflection 50%, clear 50% thick. 0.8 wing 20 no cover | 547 | 547 | 541 | 528 | 488 | 420 | 176 | 124 | 98 | 77 | 61 | 51 | 44 | 39 | 35 | 32 | 30 | 28 | 25 |
| High reflection 50%, clear 50% thick. 0.8 wing 15 no cover | 527 | 526 | 515 | 498 | 456 | 435 | 265 | 131 | 113 | 95 | 78 | 62 | 52 | 44 | 39 | 34 | 30 | 27 | 23 |
| High reflection 50%, clear 50% thick. 0.8 wing 10 no cover | 504 | 500 | 486 | 484 | 446 | 435 | 405 | 252 | 137 | 112 | 100 | 81 | 68 | 56 | 48 | 41 | 38 | 32 | 25 |

| | 0 | 10 | 20 | 30 | 40 | 50 | 60 | 70 | 80 | 90 |
|---|---|---|---|---|---|---|---|---|---|---|
| LED only | 397 | 389 | 371 | 344 | 302 | 258 | 199 | 144 | 83 | 27 |
| High reflection 100% 1.2 mm thick. 10 mm wing 70 deg. | 510 | 490 | 442 | 405 | 148 | 90 | 69 | 42 | 25 | 17 |
| High reflection 100% 1.2 mm thick. 10 mm wing 60 deg. | 468 | 465 | 445 | 392 | 346 | 100 | 55 | 32 | 21 | 16 |
| High reflection 100% 1.2 mm thick. 10 mm wing 50 deg. | 440 | 432 | 418 | 397 | 343 | 261 | 50 | 30 | 19 | 16 |
| High reflection 100% 1.2 mm thick. 10 mm wing 40 deg. | 409 | 405 | 387 | 363 | 337 | 270 | 198 | 23 | 16 | 16 |
| High reflection 100% 1.2 mm thick. 10 mm wing 30 deg. | 401 | 396 | 378 | 350 | 315 | 277 | 230 | 80 | 17 | 18 |

Comparison with different wing length at 70 degree

Comparison with different wing length at 75 degree

Comparison with different wing length at 60 degree

Comparison with different wing length at 65 degree

LED ILLUMINATION DEVICE HAVING LIGHT REFLECTING AND TRANSMITTING MEMBER

TECHNICAL FIELD

The present invention relates to a light emitting diode lighting device, and more particularly to a straight tube light emitting diode lighting device.

BACKGROUND ART

An LED can reduce power consumption and can provide the same level of illuminance and light energy as conventional incandescent and fluorescent lamps, as compared to conventional lighting devices. For this reason, LEDs are expected to further spread in the future. The straight tube light emitting diode type illumination device has an appearance similar to that of a fluorescent lamp that can be used as a substitute light source for a fluorescent lamp, and thus can be attached to an existing fluorescent lamp fixture. For example, Patent Literatures 1 and 2 describe straight tube type LED lighting tubes.

The straight-tube type LED lighting device of the present invention can uniformly irradiate light from an LED light source at a wide angle. The conventional LED lighting tube cannot distribute light in the light emitted from the LED light source and cannot vary the light distribution intensity of the light from the LED light source.

PRIOR ART DOCUMENT

Patent Document

1. Patent publication number 2014-053267
2. Patent publication number 2013-219004

DISCLOSURE OF THE INVENTION

The object of the invention can emit light emitted from an LED light source widely.

Means for Solving the Problem

The light emitting diode type illumination device according to the invention comprises an LED illumination tube provided with a total luminous flux transmission plate disposed in the light irradiation direction, and an LED element provided on the substrate opposite the total transmission plate in the LED illumination tube, and a light reflecting member provided with a light collecting and reflecting surface disposed on the light emitting side of the LED element, wherein the light reflecting member is disposed to extend in the light irradiation direction symmetrically or asymmetrically with respect to the center line of the LED element, and the light distribution and intensity of the light emitted from the LED element are controlled by light distribution illuminance (light intensity and distribution) control means.

In one embodiment of the present invention, the light reflecting member comprises a light directing formation surface for irradiating outside of the tube through a total luminous flux transmission plate from the tube with light directivity to the light emitted from the LED element and a pseudo LED element formation surface for projecting a pseudo LED element of the LED element.

The light reflecting member of the lighting device comprises slits and/or nano-sized pores, and/or has a light transmitting material.

In the light emitting diode type illumination device, the light distribution illuminance control means comprise the light distribution illuminance control means forms a light distribution intensity distribution curve, and this distribution curve comprises in the region of 90 degrees in the radial direction from directly under the LED light source (angle 0 degree) (a) A light distribution intensity activation region of a light transmissive reflective member, (b) a light distribution intensity attenuation region, and (c) a light distribution intensity reduction region.

In the light emitting diode type illumination device, the light distribution illuminance control means varies the elevation angle of the light reflecting member, and/or varies the length of the light reflecting member, and/or changes the light transmittance of the light reflecting member, and/or vary the direction of illumination of the light from the light confinement means, and/or arrange at least one reflector with an angle to distribute the radiation in the recess forming the light confinement means, and/or forms a curved surface and/or unevenness on the side of the light reflecting member facing the full light flux transmitting plate, and/or disposing the reflecting member on the substrate on which the LED element is disposed.

The reflecting member is connected to the first reflecting member disposed extending in the light irradiation direction symmetrically or asymmetrically with respect to the center line of the LED element with respect to the installation surface of the light source and a second reflection member is provided along the shape of the total luminous flux transmission plate.

The first light reflecting plate is varied at an elevation angle of 2 to 5 degrees, preferably 30 degrees or more with respect to the substrate.

The light emitted from the LED element is provided with a light confining means for confining in all light flux transmitting plate and/or in the space between the all light flux transmitting plate and the light reflecting member and for emitting the outside of the tube through the all light flux transmitting plate.

The reflective member has light transmission characteristics and/or light reflection characteristics.

Effect of the Invention

The light emitting diode type illumination device according to the present invention includes a light distribution to light from the LED light source, and provides diversity in the light distribution intensity of the light emitted from the LED light source.

BRIEF DESCRIPTION OF THE DRAWINGS

FIG. 7(*b*) is a schematic view which shows the light distribution of the irradiation from the LED element of the conventional illuminating device.

FIG. 7(*c*) is a schematic view which shows the light distribution from the LED element of the illuminating device based on this invention.

EMBODIMENTS TO CARRY OUT THE INVENTION

The light emitting diode type illumination device according to the present invention comprises an LED illumination tube having a total luminous flux transmission plate disposed in a light irradiation direction, and a light source disposed on a substrate facing the total luminous flux transmission plate in the LED illumination tube. And a light reflecting member provided with a light reflecting surface having a light reflecting property disposed on the light emitting side of the LED element, and light confined from the LED light source in the light confinement means, and illumination intensity activating means for activating and illuminating the illumination intensity. The light reflecting member is disposed to extend in the light emission direction symmetrically or asymmetrically with respect to the center line of the LED element.

Figure 4:
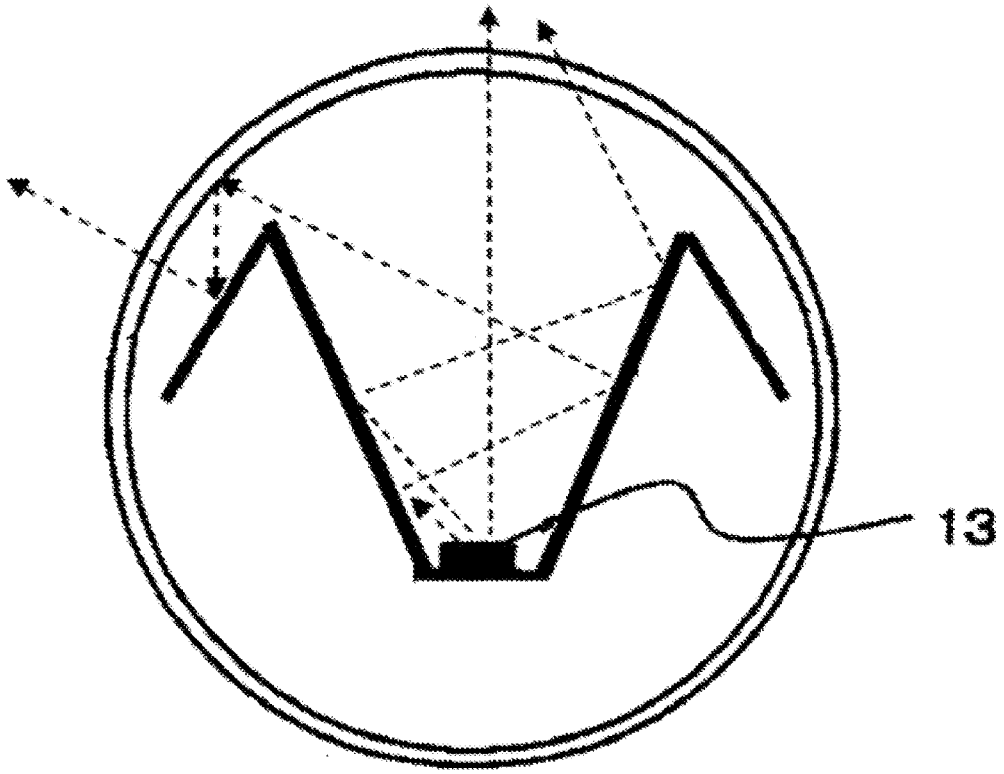
FIG. 4 is a schematic view showing an optical path of the illumination device shown in FIG. 3.
Figure 5:
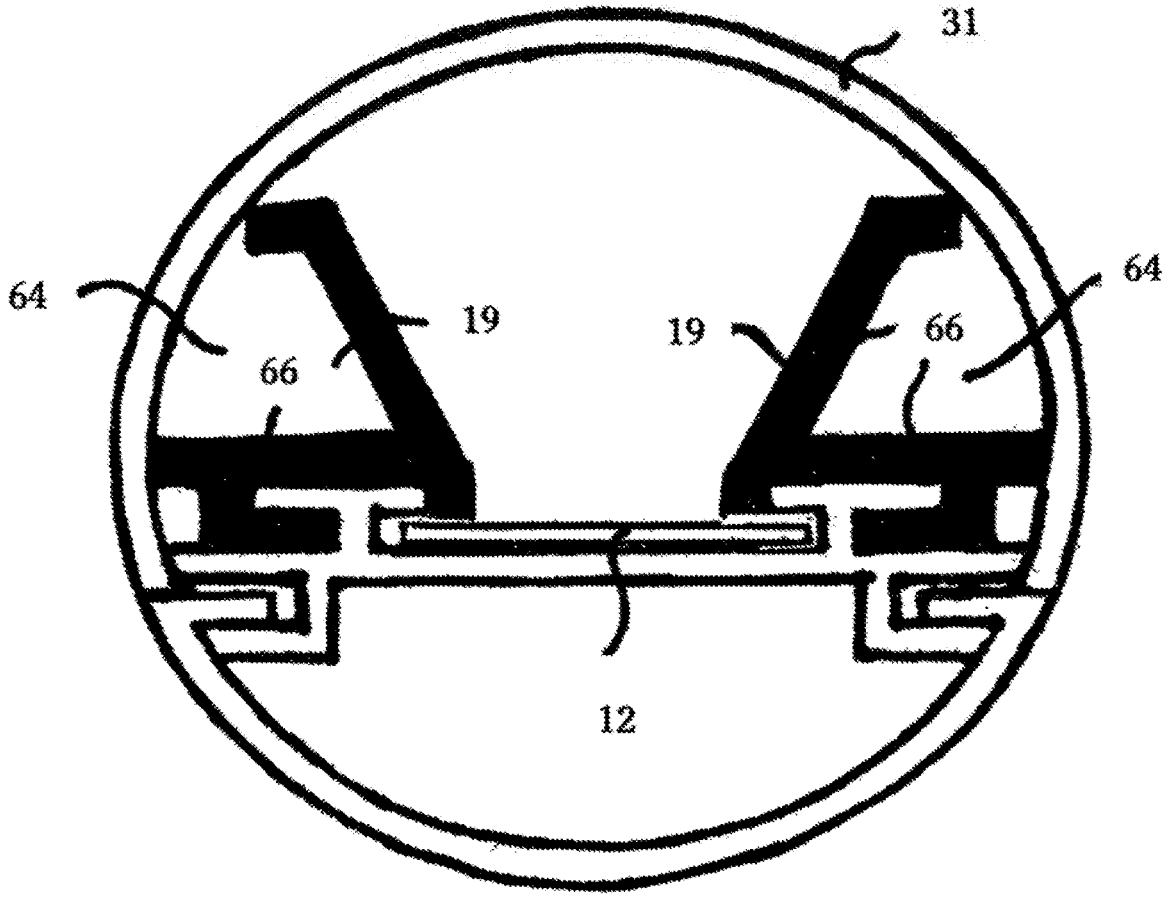
FIG. 5 is a schematic view showing light confinement means for light emitted from the light source of the LED element in a lighting device.

FIG. 4 is a schematic view illustrating the path of light emitted from the light source of the LED element in the light emitting diode type lighting device.

In FIG. 4, the light reflecting member includes a first reflecting member and a second reflecting member. The reflective member preferably comprises a heat sink member such as an AI member. The first reflection member is set at an elevation angle of 2 to 5 degrees, preferably 30 degrees or more, preferably 40 degrees to 85 degrees, preferably 50 degrees to 65 degrees, and more preferably 85 degrees to 120 degrees with respect to the substrate. The second reflection member is disposed in the wide-angle direction outward from the first reflection member along the shape of the total luminous flux transmission plate.

In FIG. 4, the light emitted from the LED element travels straight through the internal space of the first reflecting member from directly below the light source of the LED element and is irradiated from the total luminous flux transmission plate to the outside of the tube. The light is reflected by the light collection reflection surface of the first reflection member, and is emitted to the outside of the tube from the total luminous flux transmission plate through the internal space of the first reflection member. The light is reflected by the light collection reflection surface of the first reflection member, and the light that has reached the total luminous flux transmission plate through the internal space of the first reflection member is reflected by the second reflection member and is passed through the light confinement means. and irradiated from the total luminous flux transmission plate to the outside of the tube. The light transmits or transmits the light emitted from the LED element through the first reflection member, and the total luminous flux transmission through the light confinement means in the space formed between the first reflection member and the total luminous flux transmission plate, and the light is irradiated from the plate to the outside of the tube.

The light confinement means is provided on the total luminous flux transmission plate. This means is provided in the space or gap of the light reflection member which opposes all the light beam transmission boards, and/or in a recess 62 provided in the light reflecting member facing the total light flux transmitting plate, and/or in the space between the total luminous flux transmitting plate and the light reflecting member 19.

The light confinement means comprises illumination activation means comprising light confinement. The illuminance activating means is provided with a light diffusing sheet or a light diffusing form on the inner surface of the reflecting member facing the total luminous flux transmitting plate. And this or this illumination intensity activation means provides a light-diffusion sheet or a light-diffusion film in the inner surface of the reflective member which opposes a full-beam transmission board in the space provided between the reflective member and a full-beam transmission plate. This illuminance activation means may be metal plating such as gold applied to the inner surface of the reflection member. This illuminance activation means may be provided outside the center line of the LED light source. This illumination intensity activation means may be provided in the direction which irradiates more light from the side which goes to the light diffusion sheet or the light diffusion film. It is preferable that this illuminance activation means be provided with asperities.

The first reflection member includes a light directing formation surface for irradiating outside of the tube through a total luminous flux transmission plate from LED illumination tube for forming a light directing the light emitted from the LED element.

The second reflection member includes a light reflection surface provided with light reflection characteristics provided opposite to the total luminous flux transmission plate and disposed in the illumination tube. The second reflection member is preferably disposed in the wide-angle direction outward from the end of the first reflection member along the shape of the total luminous flux transmission plate. The second reflection member is provided along the curved surface of the total luminous flux transmission plate. The LED illumination tube does not have to be provided with the total luminous flux transmission plate disposed in the light irradiation direction. The reflecting member may be provided with a third light reflecting member between the first reflecting member and the second reflecting member. The light reflecting member can be provided with a shape closer to the shape of the curved surface of the total luminous flux transmission plate by providing the third light reflecting member.

Figure 6:
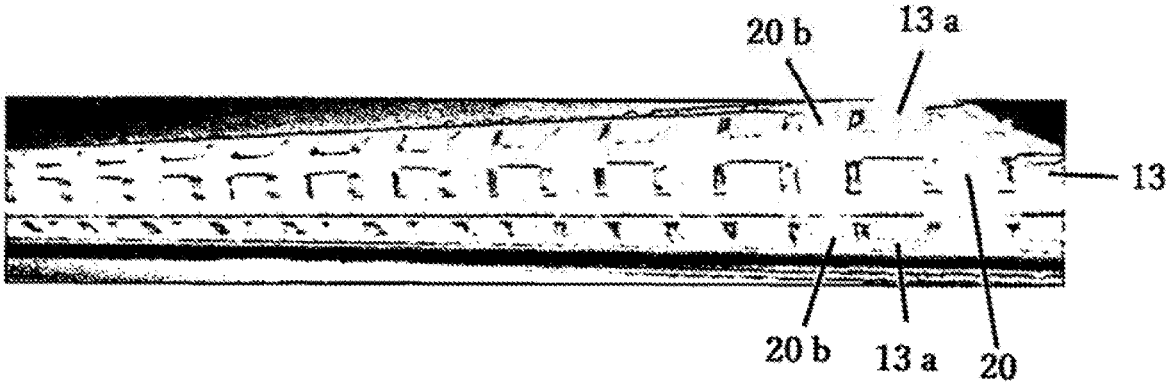
FIG. 6 is a photograph in which the pseudo LED element of the LED element mounted on the substrate in the illumination device shown in FIG. 1 is seen in the light reflection member.

The first light reflecting member is the light directivity forming surface for irradiating the outside of the tube from the LED illumination tube, and a pseudo LED element forming face for projecting a pseudo LED element of the LED element mounted the substrate on the light collecting reflection surface on the side facing the LED element. In the light emitting diode type illumination device according to one embodiment of the present invention, the light reflecting member comprises a light directing formation surface for irradiating outside of the tube through a total luminous flux transmission plate from the tube with light directivity to the light emitted from the LED element and a pseudo LED element formation surface for projecting a pseudo LED element of the LED element. The pseudo LED element formation surface preferably shows the pseudo LED elements of the LED device mounted on the substrate on the first light reflection member, preferably on the pseudo LED element formation surface in a plurality of for example, 2, 3, 5 rows. The pseudo LED element forming surface may form a light directivity forming surface. In FIG. 6, when the light emitted from the LED element disposed on the substrate is viewed from the direction in which the light is emitted, the pseudo LED element of the LED element mounted on the substrate is shown in the LED formation surface.

Figure 7A:
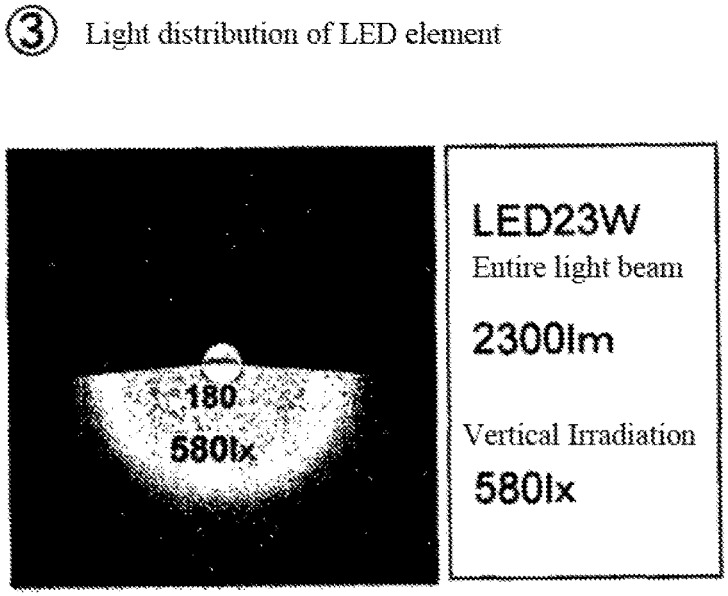
FIG. 7(*a*) is a schematic view which shows the light distribution of the irradiation from a LED element.
Figure 7C:
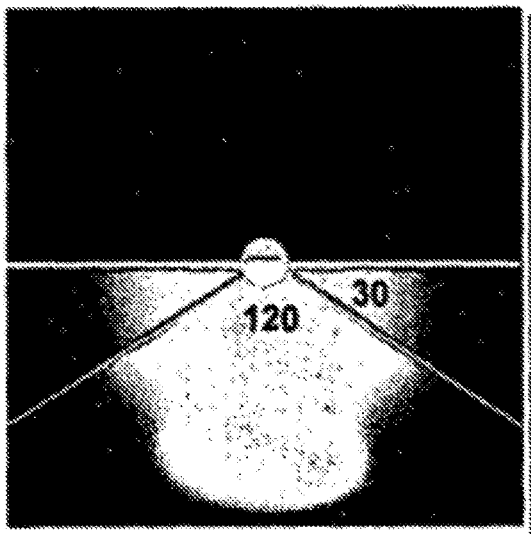

FIG. 7*a* shows the light distribution of the illumination from the LED light source. FIG. 7*b* shows the light distribution from a conventional straight tube LED light source. FIG. 7*c* shows the light distribution from the straight tube LED light source of the present invention.

As shown in FIG. 7*b*, since the light distribution from the conventional straight tube type LED light source is usually designed with a light distribution of 120 degrees, the light distribution does not effectively use 30 degrees left and right. By employing the light distribution illuminance control means of the present invention, it is possible to effectively utilize 65 degrees left and right from the center line of the light source. Therefore, the light distribution can utilize 90 degrees left and right from the center line and can redistribute light up to 180 degrees (FIG. 7 *c*). The illuminance is higher by 10% or more, preferably 50% or more, in the region of 120 degrees from the center line.

The reflecting member preferably has a total reflectance of 40% or more. The light reflecting member preferably has a light transmittance of 50% or more. Preferably, a graphene film or highly transparent polycarbonate is used to enhance the light transmission properties.

The orientation illumination control means varies the elevation angle of the light reflecting member. And/or this means varies the length of the light reflecting member. And/or this means changes the light transmittance of the light reflecting member. And/or this means changes the light irradiation direction. The reflective member is provided on a substrate on which the LED element is disposed.

The at least one reflector is angled to distribute the light of the illumination into the recess. The reflecting member is provided with a curved surface and/or an unevenness on the side facing the total luminous flux transmitting plate.

When the confining means is a space between the first reflection member and the total luminous flux transmission plate, the light distribution illuminance control means can be a fourth reflecting member 80 disposed in a position from −30 degrees to +30 degrees with respect to the LED installation position on the side facing the total luminous flux transmission plate.

Preferably, the light reflecting member has light reflecting properties and light transmitting properties. The light reflecting member comprises (1) a light transmitting means, for example a slit or a nano-sized pore, for introducing light into the light confinement means, and/or (2) the transmitting light, and/or the light transmitting is preferable to use an excellent material. The light reflecting member may be a mixture of a high reflectance polycarbonate and a high transmittance polycarbonate. or may be formed of high permeability polycarbonate. The light reflection member may be provided with a high reflection member on the surface. The light reflecting member is preferably made of a resin such as polycarbonate or acrylic, a metal material such as aluminum, iron or stainless steel, glass, wood, paper, or Japanese paper.

Figure 8:
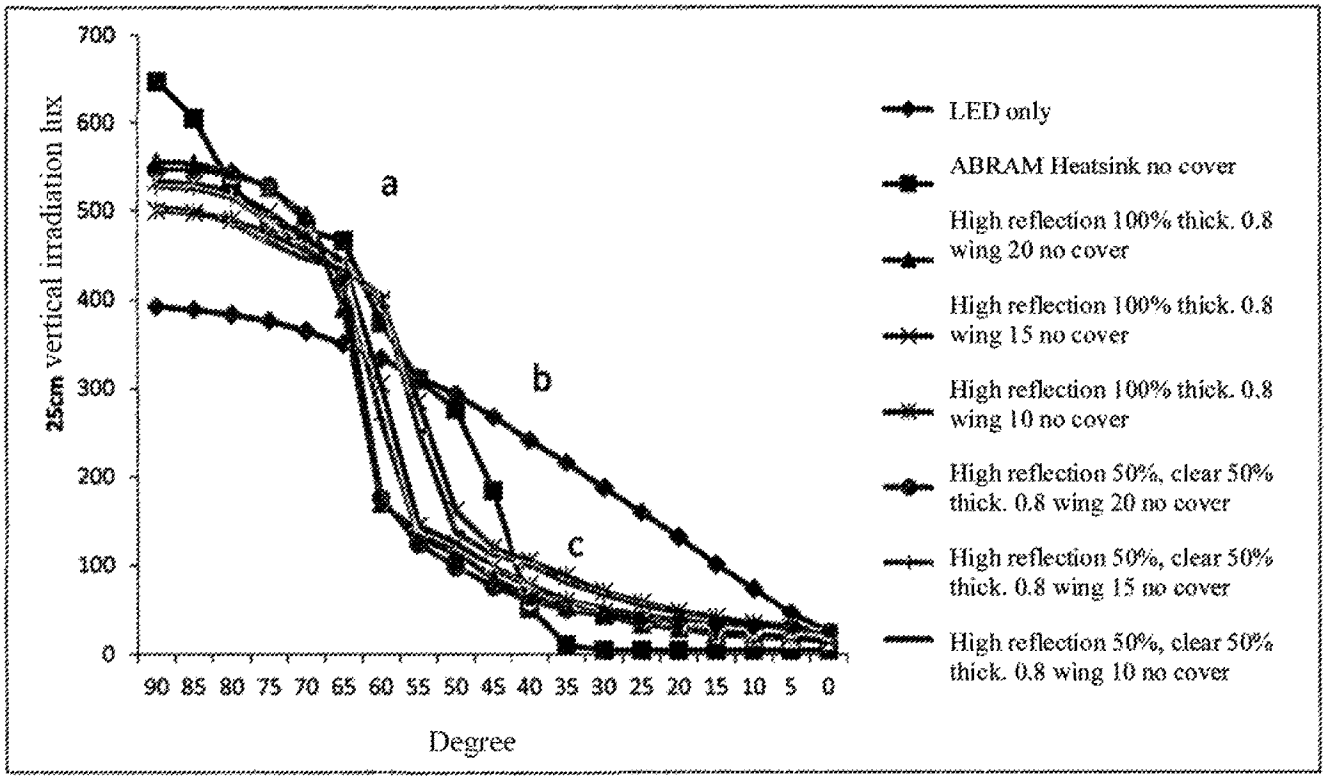
FIG. 8 is a schematic view showing a curve of light distribution intensity distribution of the lighting device according to the present invention.

FIG. 8 shows a light distribution intensity distribution curve of light emitted from the LED light source. In FIG. 8, the vertical axis represents illuminance (lux), and the horizontal axis represents light distribution intensity. The illuminance is the illuminance 25 cm above the position of light emission of the LED element in a state in which the total luminous flux transmitting plate is not attached. The illuminance and irradiation intensity of the light distribution intensity distribution curve are values measured at an elevation angle of the light reflecting member: 60 degrees, an LED light source: 20 W, and a total luminous flux: 2640 lm. If this condition is satisfied, the illuminance and the irradiation angle of the distribution curve of the light distribution intensity are different. Also, if the installation condition of the light reflecting member on the substrate is changed, the distribution curve of the light distribution intensity is changed.

In FIG. 8, (1) is a single LED, (2) is a high reflectance polycarbonate and has a thickness of 0.8 mm, a length of 20 mm, 15 mm, and 10 mm; (3) is a polycarbonate with a high reflectance of 50% and a high transmission of 50, and a thickness of 0.8 mm, a length of 20 mm, 15 mm and 15 mm, and a length of 10 mm. And, the figure shows the light distribution angle and illuminance (lux) of each material.

In FIG. 8, the light distribution illuminance control means shows a curve of light distribution intensity distribution in a region of 90 degrees in the radial direction from immediately below (zero angle) the light source of the LED element. They are a light distribution intensity activation region of the light transmissive light reflecting member, a light distribution intensity attenuation area, and a region directly below the light distribution intensity. The light distribution intensity attenuation region is a region attenuated to at least 80% to 20% of the activated light distribution intensity. The area immediately below the light distribution intensity is an illuminance intensity reduction area having illuminance intensity lower than that of the light distribution intensity attenuation area.

In FIG. 8, (a), it is preferable that a light distribution intensity activation area (a), a light distribution intensity attenuation region (b), and an irradiation intensity reduction area (c) of the light distribution curve are respective areas of at least (a) 0 to 15 degrees, (b) 25 degrees to 40 degrees, and (c) 60 degrees to 90 degrees left and right from directly below the LED light source.

Figure 9:
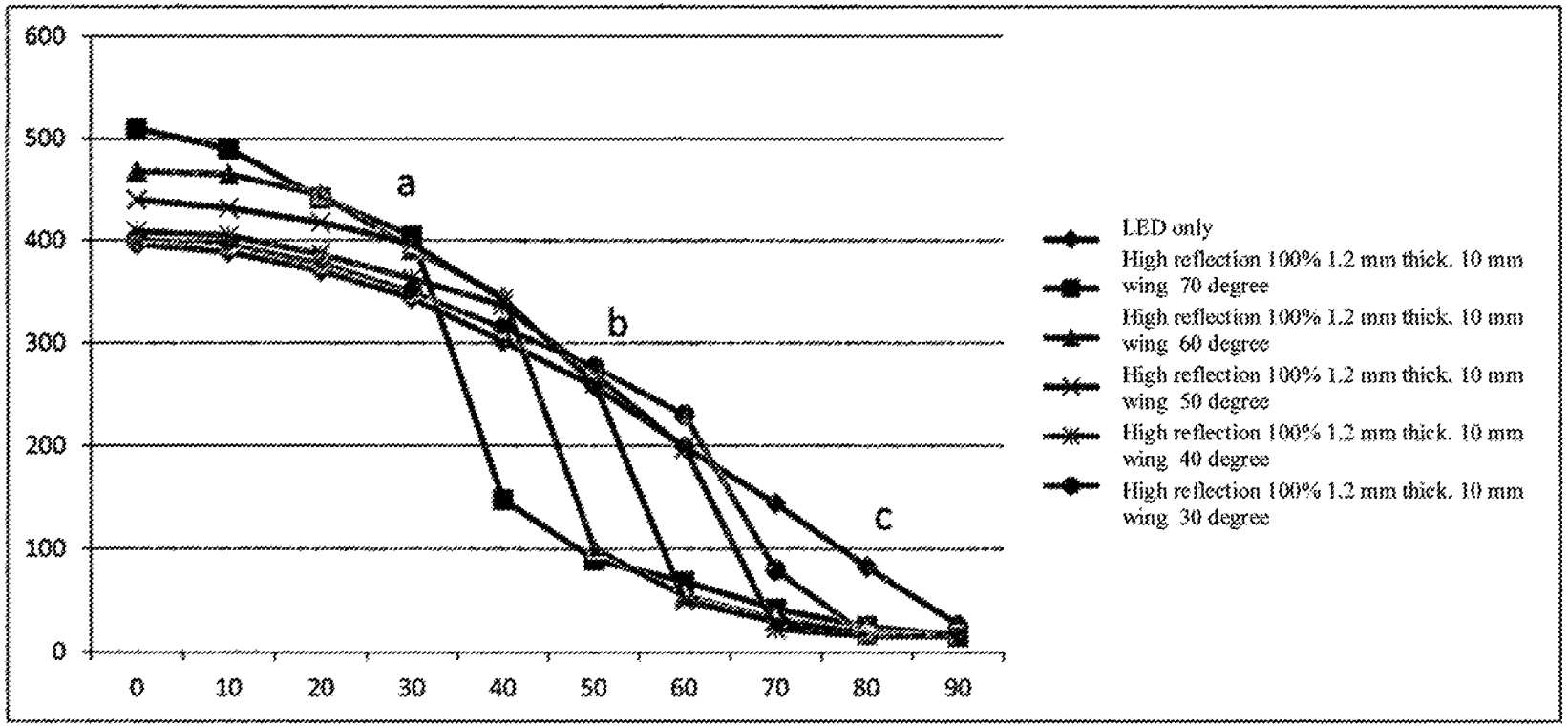
FIG. 9 is a schematic view showing a curve of another light distribution intensity distribution of the lighting device according to the present invention.
Figure 10:
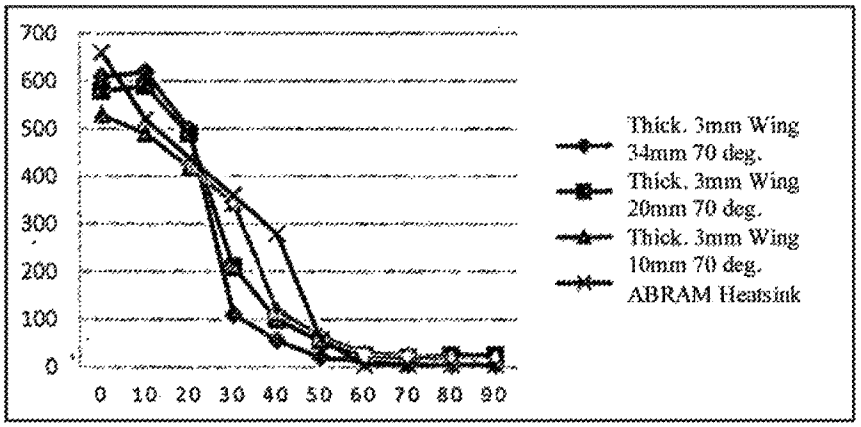
FIG. 10 is a schematic view showing still another light distribution intensity distribution of the lighting device according to the present invention.
Figure 10:
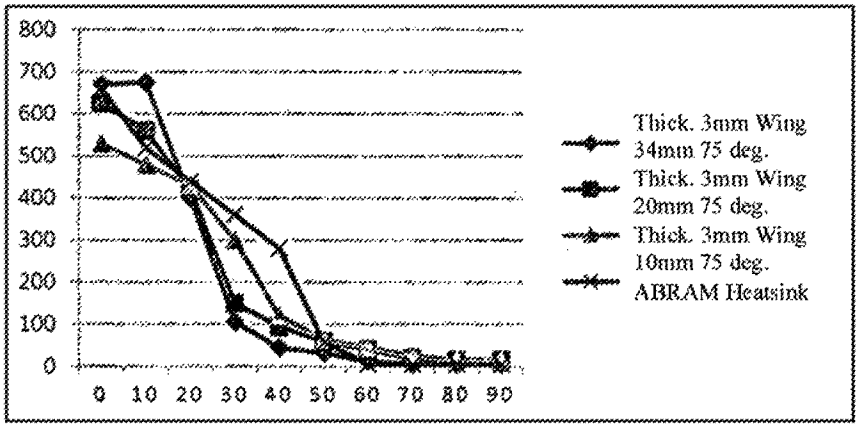
Figure 10:
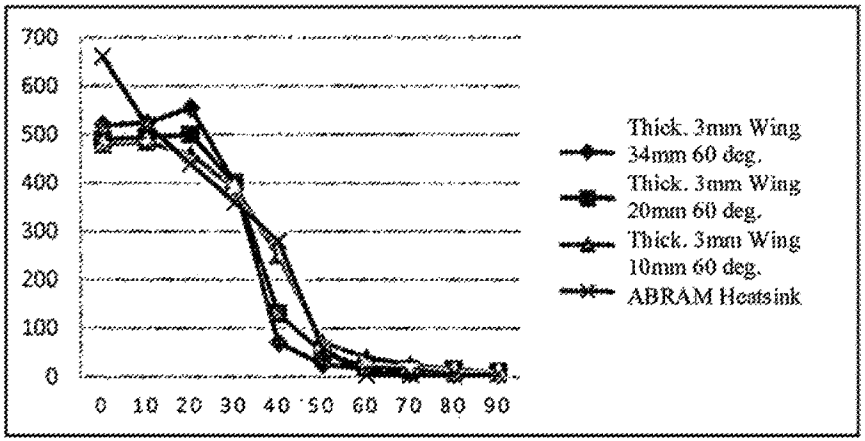
Figure 10:
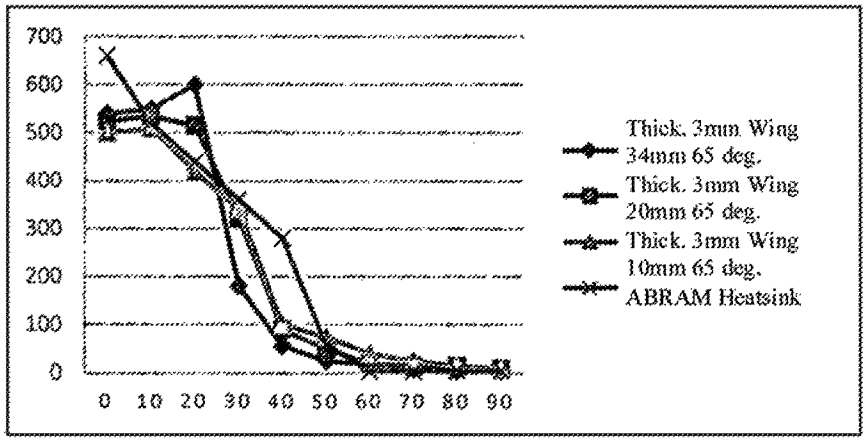

FIG. 9 shows a light distribution intensity distribution curve when the elevation angle of the light reflecting member is changed from 70 degrees to 30 degrees. A light distribution curve similar to that of FIG. 8 is obtained. In FIG. 9, the light distribution intensity activation area (a), the light distribution intensity attenuation region (b) and the irradiation intensity reduction area (c) of the light distribution curve have an area of at least (a) 0 degree to 20 degrees, (b) 35 degrees to 45 degrees, and (c) 50 degrees to 90 degrees to the left and right of the LED light source, respectively.

The light distribution illuminance control means preferably comprises an attenuation illuminance width of the light distribution intensity attenuation region of 200 lux, preferably at least 300 lux, as shown in FIG. 9.

The elevation angle of the first light reflecting plate is set to 40 degrees to 85 degrees. The distance between the edge of the arrangement of the LED elements and the first reflection plate is set to 0.1 to 5.0 mm. The height of the first light reflecting plate is set to 5 times or more of the width of the LED element, preferably 10 to 20 mm. As a result, the light reflection plate can obtain a wide irradiation angle, and can eliminate the loss of light quantity, and can improve the illuminance and the PPFD. The illuminance emitted by the LED light source is preferably 1.5 to 2.0 times. The elevation angle of the first reflection member with respect to the substrate, the distance between the end of the LED element and the reflection plate, and the height of the reflection plate are varied according to the drive voltage and light flux of the LED and the diameter of the LED irradiation tube.

The tube of the light emitting diode type lighting device can have various shapes without being limited to a substantially semi-cylindrical shape. The tube is made of glass or synthetic resin or the like. The tube may be a member integrally formed of a material having a predetermined elasticity such as polycarbonate resin so as to be a long semi-cylinder. The whole or a part of the tube may be formed of a translucent, transparent, translucent or colored transparent material.

The LED element is a surface-mounted white LED that emits white light when a predetermined voltage is applied. It is preferable that the LED elements be arranged at regular intervals so as to be aligned in the longitudinal direction of the substrate at a central position in the width direction on the front surface side of the substrate. The LED elements may be arranged in multiple rows along the longitudinal direction of the substrate.

Embodiment

Hereinafter, an embodiment of the present invention will be specifically described with reference to the attached drawings. The present invention is not limited to the embodiments. A person skilled in the art may make various changes, combinations, or substitutions of the components of the embodiment within the technical scope of the present invention or the equivalent thereof.

Figure 1:
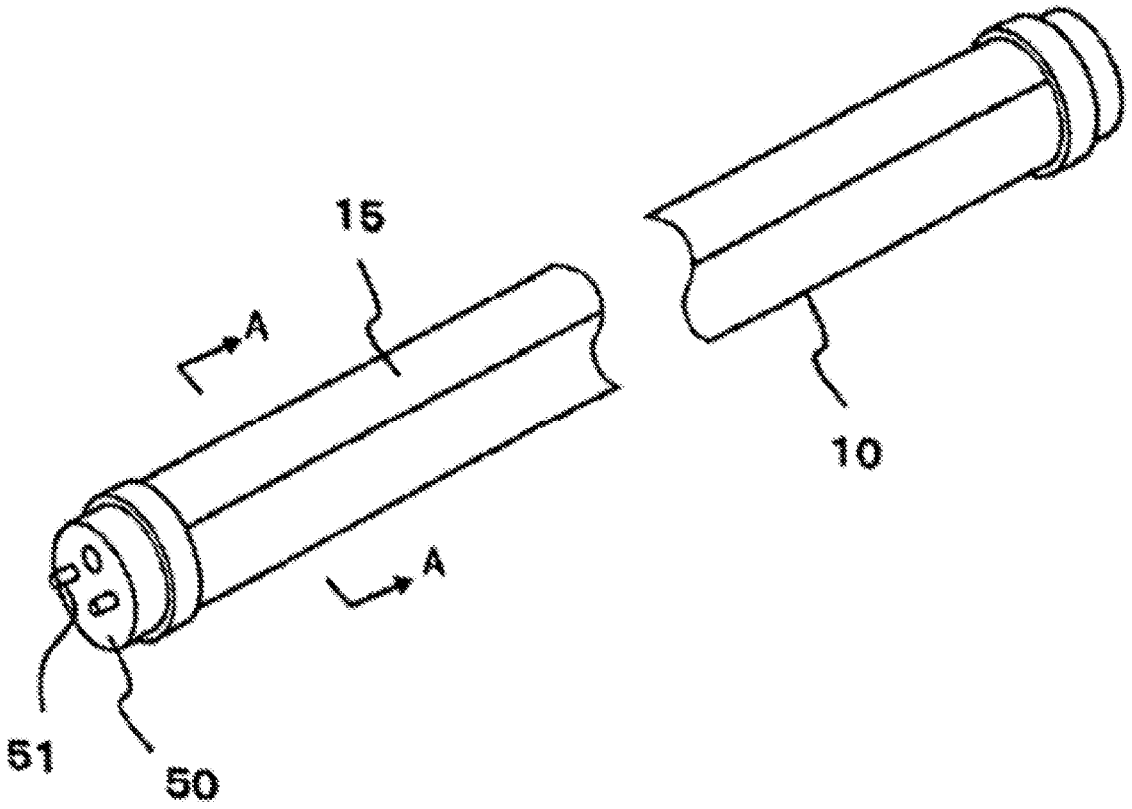
FIG. 1 shows a straight tube light emitting diode type lighting device according to the present invention.
Figure 2:
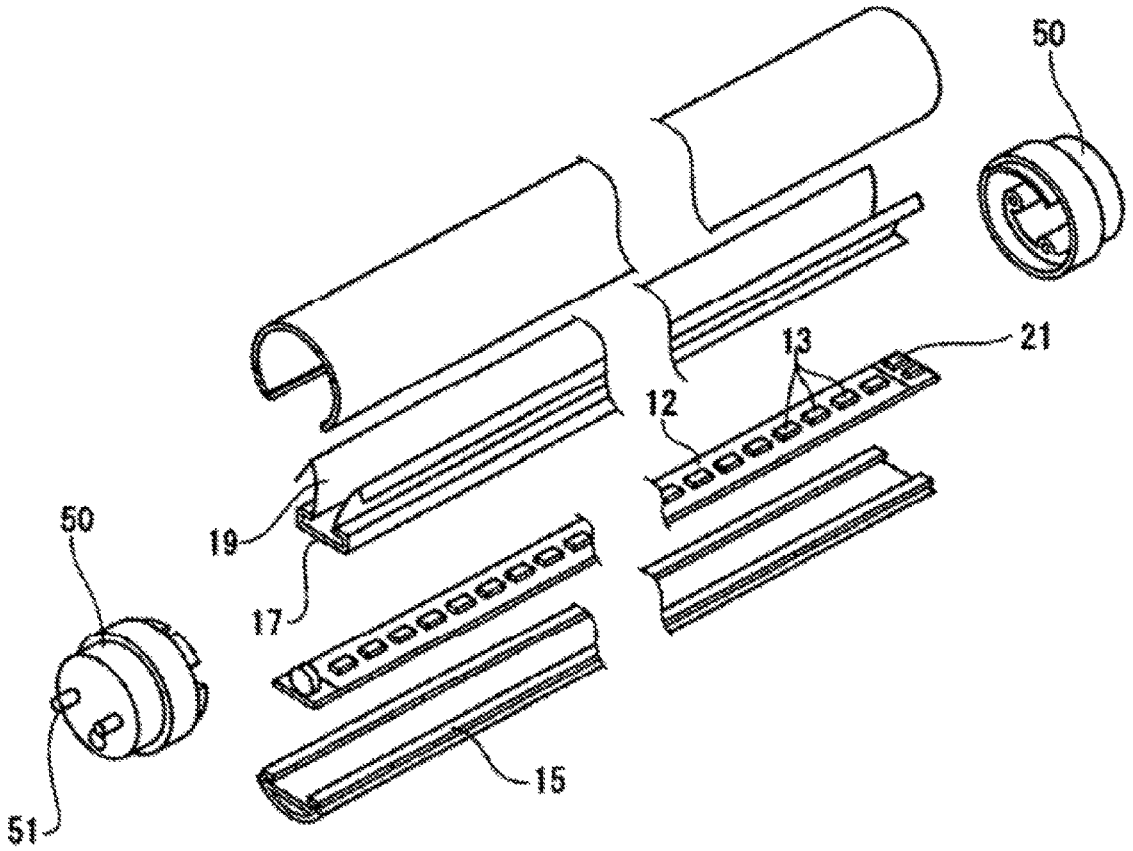
FIG. 2 shows an exploded perspective view of the lighting device shown in FIG. 1.

FIG. 1 is a schematic view showing a light emitting diode type lighting device according to the present invention. FIG. 2 is an exploded perspective view of the straight tube light emitting diode lighting device shown in FIG. FIG. 3 is a cross-sectional view of the straight tube light emitting diode lighting device shown in FIG. 1, taken along line AA.

Figure 3:
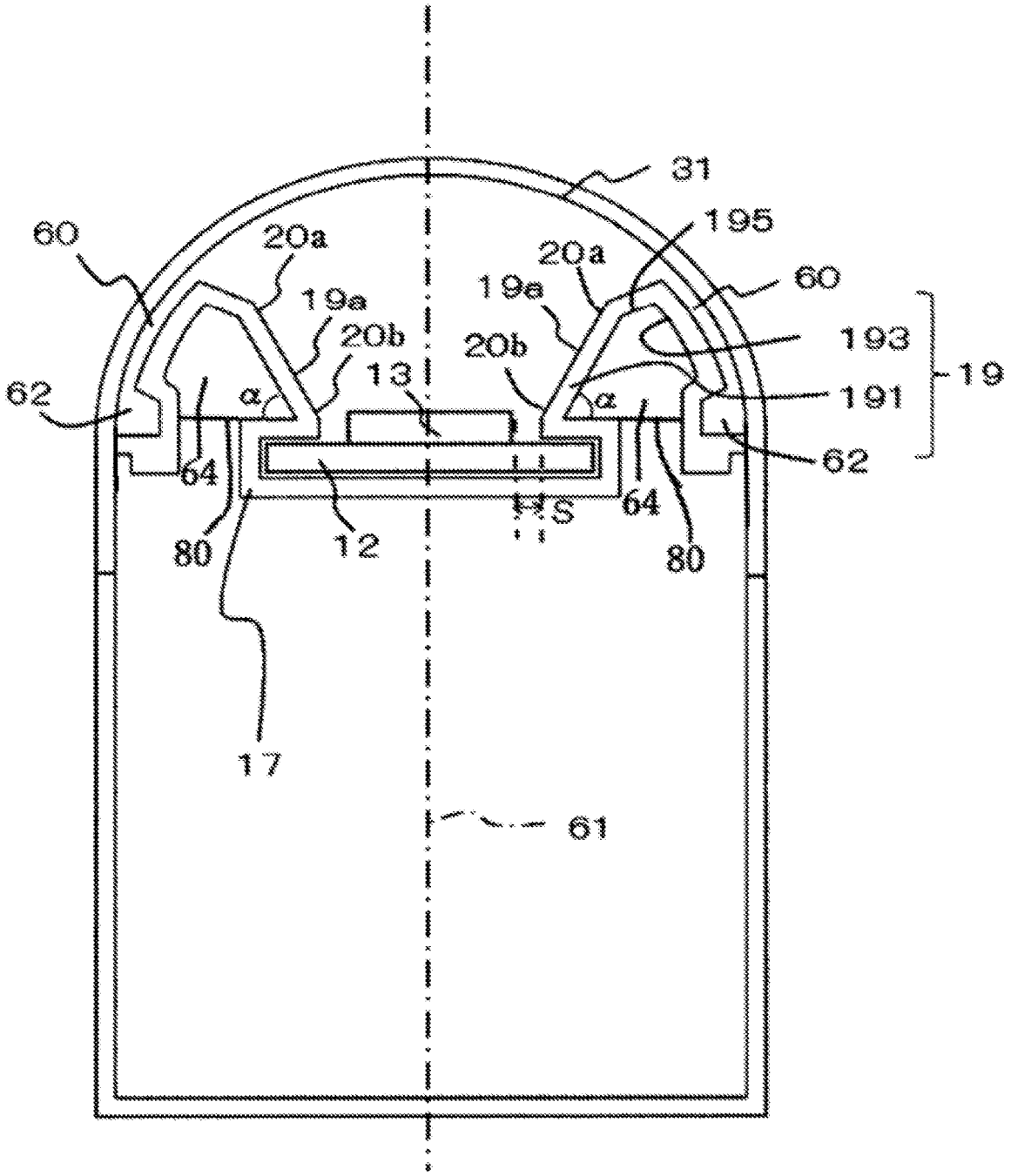
FIG. 3 shows a sectional view taken along line AA of the illumination device shown in FIG. 1.

The light emitting diode type illumination device 1 shown in FIG. 3 includes a cylindrical tube 10 provided with a translucent cover (a total luminous flux transmission plate 31) and a pipe member 15 provided with a full luminous flux transmission plate, and a light source of an LED element disposed inside the cylindrical tube 10, the substrate 12 on which the LED element 13 is mounted, the substrate support member 17, the light reflection member 19, the LED controller, and the end cap 50.

The light reflecting member 19 includes a first light reflecting member 191, a second light reflecting member 193, and a third light reflecting member 195. The tube member, the substrate support member 17, the first light reflecting member 191, the second light reflecting member 193, and the third light reflecting member 195 may be made of a heat sink material such as aluminum, copper, iron, or plastic preferable. The light reflecting member is made of a mixture of a high reflectance polycarbonate material and a high transmittance polycarbonate material.

In the embodiment, it is preferable that the substrate support member 17 and the first light reflection member 191 be integrally formed. It is preferable that the first light reflecting member 191, the second light reflecting member 193, and the third light reflecting member 195 be integrally formed. It is preferable that the substrate supporting member 17, the first reflecting member 191, the second light reflecting member 193, and the third light reflecting member 195 be integrally molded. If plastic is used for these members 17, 191, 193, 195, these members can be easily integrally molded. Alternatively, these members may be made separately, and then these members may be bonded with an adhesive, screws or the like.

The support member 17 of the substrate and the light reflection member 19 are integrally formed. It is preferable that the light confined in the light confinement space such as the recess 62 of the light reflection part is irradiated from the total luminous flux transmission plate 31 to the outside of the tube.

The light reflecting member 19 and the support member 17 may be made separately and then fixed with screws or an adhesive. The light reflecting member 19 may be detachably attached to the locking portion. Preferably, the first light reflecting member 19 is integrally provided on the substrate 17.

By using the heat sink members, the pipe member 15, the support member 17 of the substrate, and the light reflecting members 191, 193, and 195 can obtain a high heat dissipation effect. For example, when the heat sink member is made of aluminum, the temperature of the portion touched by the human body can be made safe at 40° C. or less. The heat sink material is preferably aluminum or copper having excellent thermal conductivity.

As shown in FIG. 3, the substrate 12 is housed and supported in a longitudinally shaped internal space (closed space) of the support member 17 of the substrate. The LED element 13 is disposed in a stripe-like opening formed on the side of the light-transmissive cover (the total luminous flux transmission plate 31) of the support member 17 of the substrate, with the light emitting surface facing the full luminous flux transmission plate.

As shown in FIG. 3, the LED element 13 is disposed on the center line 61 of the total luminous flux transmitting plate 31, which is a cross section of the closed space of the lighting device 1. The total luminous flux transmission plate 31 preferably has a total luminous transmittance of 95% or more. This transmission version used ML series which is a high diffusion type manufactured by Teijin Limited. Here, the total luminous transmittance (%) is represented by the total luminous flux when the test piece is placed and the total luminous flux when the test piece is not placed×100.

The LED elements mounted on the substrate 12 are arranged in one row or a plurality of rows at predetermined intervals in the longitudinal direction of the substrate. As shown in FIG. 2, a plurality of LED elements are mounted on the substrate 12 at equal intervals along the longitudinal direction. The substrate 12 comprises an LED controller 21 at its end. It is preferable that the first light reflecting member is provided with the light collecting reflection surface 19*a* on the LED element side. It is preferable that the light collecting reflection surface 19*a* includes a light directing formation surface 20*a* and a formation surface 20*b* of a pseudo LED element for projecting a pseudo LED element of the LED element mounted on the light reflection surface on the side facing the LED element.

The spacing length (S) between the end of the LED element and the light condensing reflection surface of the first reflection member 19 is set to 0.1 mm to 5.0 mm, preferably 0.5 mm to 2.0 mm, and the first light. The elevation angle $\alpha$ of the reflecting member 19 is set to 45 to 85 degrees, preferably 50 to 65 degrees, and the total reflectance of the reflecting member is set to 80% or more. The interval may be zero as long as an electrical insulating material is provided on a part of the light collecting reflection surface.

The first light reflecting member 19 extends along the curved shape of the first light reflecting member 191 extending at a predetermined elevation angle. A third light reflecting member 195 is provided which bends and is provided with a second light reflecting member 193 and a first light reflecting member 191 and the second light reflecting member 193. The light reflecting member 19 may be formed in a multistage configuration in which light reflecting members are connected without being limited to the configuration of the first light reflecting member 191, the second light reflecting member 193, or the third light reflecting member 195.

It is preferable that the second light reflecting member 193 and the third light reflecting member 195 be provided with light reflecting surfaces 193*a* and 195*a* having light reflecting properties on the side facing the total luminous flux transmitting plate 31, respectively.

The light emitted from the LED element is irradiated to the outside of the tube through the total luminous flux transmitting plate 31 through the light reflecting member 19. The light emitted from the LED element is irradiated to the outside of the tube through the total luminous flux transmitting plate through the light condensing surface of the light collecting reflection surface 19*a* of the first light reflecting member 191. At this time, the emitted light is (1) confined in the total luminous flux transmission plate 31 disposed corresponding to the light reflection surface 193*a* of the second light reflection member 193, and/or (2) is confined in the light confinement path 60 formed between the second light reflecting member 193 and the total luminous flux transmission plate 31, (3) is confined in the recess 62 of the light reflecting member provided in the light confinement path 60, (4) is confined in the space 64 formed by the total luminous flux transmission plate 31 and the light reflecting member 19. The light thus confined is activated by the illumination activating means. The activated light is irradiated from the total luminous flux transmission plate 31 to the outside of the tube.

The light emitted from the LED element is emitted to the outside of the tube through the total light flux transmitting plate via the first light reflecting member 191. In this case, the elevation angle of the first light reflecting member 191 with respect to the substrate is set to 45 degrees to 85 degrees, preferably 50 degrees to 65 degrees. The distance (s) between the end of the LED element and the first light reflecting member is set to 0.5 to 5.0 mm, and the height of the reflecting plate is at least five times the width of the LED element, preferably it is set to 10 to 20 mm.

The irradiation angle of the light emitted from the LED element to the outside of the tube through the total luminous flux transmitting plate is 120 degrees to 180 degrees, and the total luminous flux is 2,000 to 3,000 lm.

The lightening apparatus of the present invention can set the irradiation distribution to a wide angle (140 degrees or more). Also, the illumination and orientation according to the invention is possible with 50% power consumption of fluorescent lamps. Power consumption can be reduced by about 12 to 13% compared to fluorescent lamps. Also, the illuminance and PPFD are 2 to 3 times. In addition, it does not emit high heat like fluorescent light, which contributes to safety and security. The weight of the lighting device is less than 500 g.

It is preferable that the drive device of the AC power supply is disposed below the substrate on which the LED element is mounted in the LED lighting tube or on the back side of the light collection reflection surface of the reflection member.

The forward voltage for driving the LED element is at least 1.5V to 4.5V. The drive voltage is preferably driven by a single power supply. When this voltage is applied to the LED element, when the LED element mounted on the substrate is viewed from the direction of light emitted from the LED element mounted on the substrate, the pseudo LED is projected on the formation surface of the pseudo LED.

The light emitting diode type lighting device according to the present invention is preferably a straight tube light emitting diode type lighting device. The lighting device may be used as a light source of an electronic device, for example a backlight of a liquid crystal device.

The invention claimed is:

1. A light emitting diode illumination device comprising:

an LED illumination tube provided with a light transmission plate;

an LED element provided on a substrate facing the light transmission plate in a main light irradiation direction;

light reflecting members comprising first and second reflecting members each extending from side edges of the substrate at an angle of 30 degrees or more with respect to the substrate toward the light transmission plate in the main light irradiation direction, the first reflecting member having a light directing formation surface which directs the light toward outside the LED illumination tube through the light transmission plate, the second reflecting member extending an outside end of the first reflecting member with such angle that the second reflecting member extends along the light transmission plate of LED illumination tube and having a light collecting surface which faces the light transmission plate, wherein the first reflecting member further comprises a pair of pseudo LED formation surfaces each reflecting and showing the LED element disposed at the substrate such that a plurality of pseudo LED elements are visible in a row when viewed from an outside of the LED illumination tube in the main light irradiation direction.

2. The light emitting diode illumination device according to claim 1, wherein the light reflecting members comprise means for allowing the light in part to pass through light reflecting members or a light transmitting material.

3. The light emitting diode illumination device according to claim 1, wherein the second reflecting member extends along a shape of the light transmission plate such that a light confinement path is formed between the second reflecting member and the light transmission plate.

* * * * *